US005680119A

United States Patent [19]

Magliari et al.

[11] Patent Number: 5,680,119

[45] Date of Patent: Oct. 21, 1997

[54] VEHICLE RESPONSIVE ALERT SYSTEM

[76] Inventors: Gary Magliari, 10 Cornwall Ct., Katonah, N.Y. 10536; Kevin Volpe, 547 Laurel St., East Haven, Conn. 06512

[21] Appl. No.: 659,627

[22] Filed: Jun. 6, 1996

[51] Int. Cl.[6] ..... G08G 1/00

[52] U.S. Cl. ..... 340/904; 340/531; 340/539; 340/825.31; 340/825.69; 379/39; 70/257

[58] Field of Search ..... 340/331, 332, 340/504, 506, 531, 539, 904, 825.31, 825.69, 825.72; 379/37, 39, 40; 70/257, 278

[56] References Cited

U.S. PATENT DOCUMENTS

| | | | |
|---|---|---|---|
| 3,914,692 | 10/1975 | Seaborn, Jr. | 340/504 |
| 4,536,750 | 8/1985 | Ebihara et al. | 340/531 |
| 4,747,064 | 5/1988 | Johnson | 340/906 |
| 4,775,865 | 10/1988 | Smith et al. | 340/906 |
| 5,021,780 | 6/1991 | Fabiano et al. | 340/539 |
| 5,091,930 | 2/1992 | Shapiro | 379/39 |
| 5,144,301 | 9/1992 | Jackson et al. | 340/539 |
| 5,172,097 | 12/1992 | Arnold | 340/543 |
| 5,307,060 | 4/1994 | Prevulsky et al. | 340/901 |
| 5,311,197 | 5/1994 | Sorden et al. | 342/457 |
| 5,479,482 | 12/1995 | Grimes | 379/37 |
| 5,515,043 | 5/1996 | Berard et al. | 340/988 |
| 5,563,579 | 10/1996 | Carter | 340/825.31 |

*Primary Examiner*—Jeffery Hofsass
*Assistant Examiner*—Timothy Edwards
*Attorney, Agent, or Firm*—Bachman & Lapointe

[57] ABSTRACT

A vehicle responsive alert system includes a receiver for receiving a recognizable signal from a preselected vehicle; a control member, positioned at a location and operatively associated with the receiver for enabling the receiver upon the indication of a preselected event; and a response member operatively associated with the receiver for issuing a response when the receiver receives the signal, whereby the receiver is enabled upon the indication of the event and activates the response member upon receiving the signal.

28 Claims, 5 Drawing Sheets

VEHICLE RESPONSIVE ALERT SYSTEM

BACKGROUND OF THE INVENTION

The invention relates to an alert system, particularly a vehicle responsive alert system, which is activated by the approach of an emergency or other vehicle so as to issue one or both of signals to the emergency vehicle or persons at the location of the alert system.

Businesses, homeowners, health care facilities and the like routinely require the services of vehicles that regularly arrive at and depart from their building location. For homeowners, this could be school, medical or emergency related transportation. In a business environment, this could be vehicles which pick up and deliver articles and/or persons, or for emergency related transportation. In the case of health care facilities, emergency or non-emergency vehicles regularly arrive and depart.

In each of these environments, the only way for persons at the particular location to know of the approach of a particular vehicle is to see the vehicle arrive. Furthermore, persons in the vehicle must either be familiar with the location to which they are traveling, or must lose time watching for road signs, landmarks and the like.

Specific problems are experienced with specific applications. In an emergency setting, persons requiring assistance are subjected to the anxiety and stress of not knowing when help is arriving, or even whether help has been dispatched, until the actual arrival of same. In a business environment, a shipping and receiving facility may not know of the approach of a vehicle for picking up or dropping off articles until the vehicle actually arrives at the facility. In another aspect of the home environment, a parent of a young child does not know when the child has returned home by school bus until the bus arrives, thereby resulting in one or the other of the child waiting alone after debarking from the school bus, or the parent waiting a potentially extended period of time for the school bus.

In still another environment, in a disabled vehicle, hazard lights and the like typically must be activated for an extended period of time so as to assist service and/or emergency vehicles in locating the disabled car. Since hazard lights and other indicators are typically operated by battery power from the vehicle, these indicators can rapidly exhaust the limited power source of the car well prior to the arrival of the desired help or assistance.

The foregoing situations are just several examples which clearly demonstrate the need for a system whereby persons at a particular location and/or emergency personnel are alerted to the approach of a particular emergency, transportation, assistance and/or service or delivery vehicle to the location.

Responsive to this need, it is the primary object of the present invention to provide a vehicle responsive alert system which activates a response or signal which is visible or sensible by persons in a vehicle headed to that location.

It is a further object of the present invention to provide a vehicle responsive alert system which provides a response or signal to persons located at the location thereby advising them of the approach of a particular vehicle.

It is a still further object of the present invention to provide a vehicle responsive alert system which advises persons at the location of the type of vehicle approaching the location.

It is another object of the present invention to provide a vehicle responsive alert system which operates with known signal transmitters currently being employed in various emergency and public vehicles.

It is still another object of the present invention to provide a vehicle responsive alert system which is simple, efficient and reliable in use, and which is relatively inexpensive to manufacture.

Other objects and advantages of the present invention will appear hereinbelow.

SUMMARY OF THE INVENTION

In accordance with the present invention, the foregoing objects and advantages are readily attained.

According to the invention, a vehicle responsive alert system is provided which comprises means for receiving a recognizable signal from a preselected vehicle, control means, positioned at a location and operatively associated with said means for receiving, for enabling said means for receiving upon the indication of a preselected event, and response means operatively associated with said means for receiving for issuing a response when said means for receiving receives said signal, whereby said means for receiving is enabled upon the indication of said event and activates said response means upon receiving said signal.

Still further in accordance with the invention, the system preferably further comprises a telephone system, and said control means comprises a monitor for monitoring said telephone system and for enabling said receiving means when a preselected number is dialed on said telephone system, whereby the dialing of a 911 call or some other pre-programmed call automatically activates the system of the present invention.

In further accordance with the invention, the vehicle responsive alert system is adapted to receive and identify signals from vehicles selected from the group consisting of emergency vehicles, school buses, public transportation, delivery vehicles, repair vehicles, service vehicles, commercial transportation, trains and the like.

Still further in accordance with the invention, a vehicle responsive alert system is provided which further includes means for providing access comprising a locked container holding access materials for said location, and wherein said response means unlocks said locked container when said receiving means receives said signal.

BRIEF DESCRIPTION OF THE DRAWINGS

A detailed description of preferred embodiments of the invention follows, with reference to the attached drawings, wherein.

DETAILED DESCRIPTION

The invention relates to a vehicle responsive alert system which functions in conjunction with a vehicle signaling system which is currently being adopted and which is disclosed in U.S. Pat. No. 5,497,148. Pursuant to the teachings of the known vehicle signaling system, emergency and other vehicles are being provided with emitters of signals which are intended to be identifiable.

In accordance with the invention, and advantageously, a system is provided including a receiver which is positioned at a desired location and enabled either manually, responsive to the occurrence of a particular event, or continuously, if desired, so as to receive signals from a particular desired vehicle such as emergency (police, ambulance, fire fighting, etc.) vehicles, school bus or other public transportation, service and/or delivery vehicles, trains and the like, and, upon receiving such signal, a response mechanism of the system is actuated for issuing an exterior visible signal, an interior visible signal at the desired location, or both as will be thoroughly discussed below.

Figure 1:
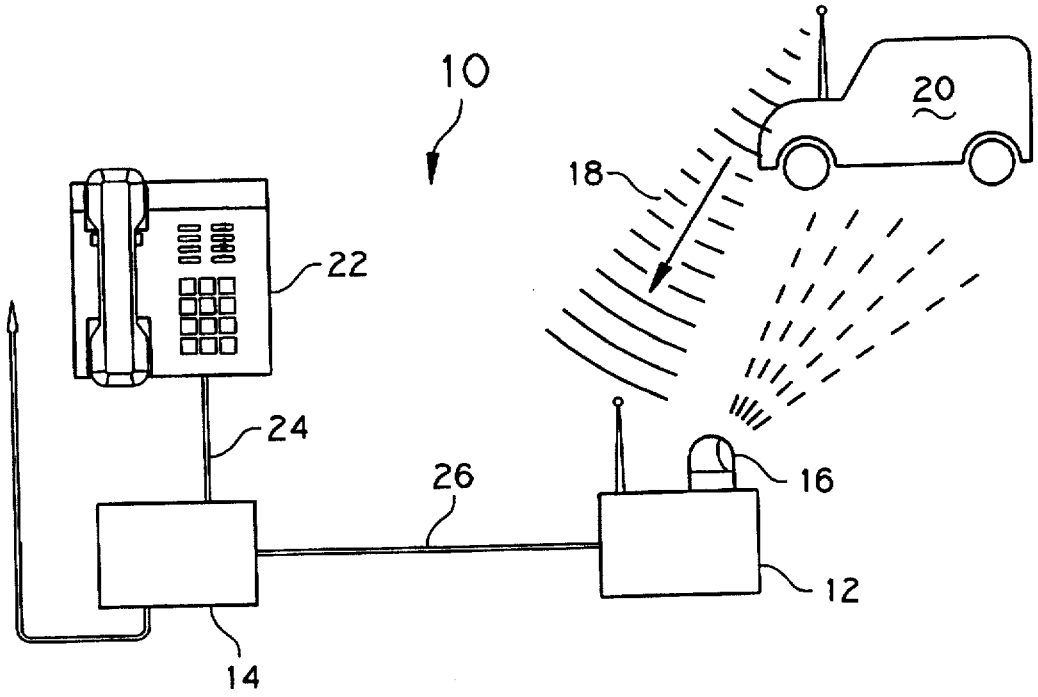
FIG. 1 is a schematic illustration of an embodiment of a vehicle responsive alert system in accordance with the invention.

Referring to FIG. 1, a schematic illustration is given of an embodiment of the present invention. In accordance with the invention, a vehicle responsive alert system is provided which is generally referred to in the drawings as reference numeral 10. System 10 according to the invention preferably includes a receiver member 12, a control member 14, and a response member 16, and these elements are interconnected or operatively associated so as to sense a signal 18 from a desired vehicle 20, and to activate the response member upon receiving a pre-selected signal 18 in accordance with the invention.

Receiver 12 in accordance with the invention may suitably comprise any conventional receiver or antenna for receiving the type of signals in use, typically RF (radio frequency) and coded RF signals. Examples of other types of signals include but are not limited to radar, audio, ultrasonic, infrared, laser and the like.

Control member 14 may be any suitable control apparatus or processor such as one or more computer chips, circuitry, switches and the like for activating receiver 12 when desired or upon the occurrence of a particular event, for processing and identifying a signal 18 received by receiver 12, and for enabling or activating response member 16 responsive to the identification of a particular pre-selected signal 18. In accordance with the invention, and advantageously, system 10 may suitably be provided at any desired location such as a home, business, health care provider, school, shipping facility and the like so as to provide a system which, when activated, generates an alert responsive to the approach of a vehicle issuing the desired signal 18.

Still referring to FIG. 1, control member 14 in one preferred embodiment may be operatively associated with a telephone system 22 so as to monitor system 22 for the dialing of a particular number such as a "911" emergency call or any other desired number. When a particular number is detected, control member 14 activates or enables receiver 12, which is now ready to receive signals 18 from vehicle 20 which responds to the emergency call by traveling to the location of system 10.

In accordance with the invention, and advantageously, system 10 is adapted so that, upon receiving a particular signal 18 at receiver 12, response member 16 is activated so as to generate a response which may suitably be an audio or visual or otherwise perceptible or detectable signal. Response member 16 is preferably positioned exterior of the structural or building location of system 10 so as to be visible to operators of vehicle 20 or positioned so as to generate a signal which is visible or otherwise detectable by an approaching vehicle 20. Thus, as soon as vehicle 20 issuing signals 18 travels to within signal range of activated receiver 12, response member 16 is activated so as to rapidly guide vehicle 20 to the location of system 10 as desired. Further advantageously, response member 16 is not activated until vehicle 20 is within a particular vicinity of the desired location, thereby conserving power which may be in limited supply and needed to operate response member 16, and avoiding operation of response member 16 before needed which may be undesirable depending upon the circumstances.

In the foregoing discussion, receiver member 12, control member 14 and response member 16 as well as telephone system 22 are discussed as being "operatively associated". This language is intended to cover situations where the various elements are connected through hard wiring or actual connections, or where the elements communicate through IR (infrared) or other remote signals, or where the elements are components of a single device, and refers to any arrangement wherein the elements are capable of functioning together. Control member 14 as set forth above in the embodiment of FIG. 1 is operatively associated with telephone system 22. In accordance with the invention, control member 14 may suitably be connected to telephone system 22, and is preferably interposed along telephone line 24 so as to pick up numbers dialed. Control member 14 may be any of a number of suitable devices which can be configured to identify certain stored telephone number sequences when dialed on a line being monitored. One example is a DTMF (Dual Tone Multi-Frequency) monitor which can be positioned in accordance with the invention at a base station or other location as desired.

In the embodiment shown in FIG. 1, control member 14 is operatively connected to receiver 12, for example through connection 26 as shown. As set forth above, this could be a hard wired physical connection, or could be a remote, transmitter/receiver arrangement or the like.

In further accordance with the invention, control member 14 preferably also includes certain comparison and switch circuitry, as well as other circuitry and/or chips as desired, and is programmed or programmable to enable or activate receiver 12 upon detecting a particular number dialed on telephone system 22. In accordance with well known technology, control member 14 may also suitably be configured so as to monitor incoming signals delivered, for example, through a telephone answering machine. In this manner, a particular code may be dialed into control member 14 from a remote location so as to activate system 10 and enable receiver 12 in the manner described above.

Control member 14 may also suitably be associated with an alarm or security system, (not shown in the drawings), and configured to activate receiver 12 when the alarm system is triggered, thereby automatically providing responding help with a guide for finding the proper location as soon as possible.

The primary purpose of response member 16 as illustrated in FIG. 1 is to attract the attention of approaching emergency or other personnel within vehicle 20 so that the desired location is easily identified. Response member 16 may issue the desired signal for attracting attention in the form of a visual alarm such as a flashing light, an audible alarm, a wireless homing signal or the like. In accordance with the present invention, response member 16 should, of course, be positioned for maximum visibility to vehicular traffic approaching the desired location. Response member 16 may suitably be positioned to indicate a particular residence or other structure, or may be positioned to indicate the location of particular areas of interest such as windows of bedrooms of young children, the location of fire hydrants or other public safety equipment, and the like.

In accordance with the invention, the response generated by response member 16 also preferably serves to alert persons at the particular location that the vehicle 20 of interest is approaching. This can be accomplished with a signal issued from the same response member 16, or with a different signal such as a visual or audible alarm from the same response member 16, or using an additional response member as discussed below which would be visible or audible or otherwise detectable to persons located at the particular location.

Figure 2:
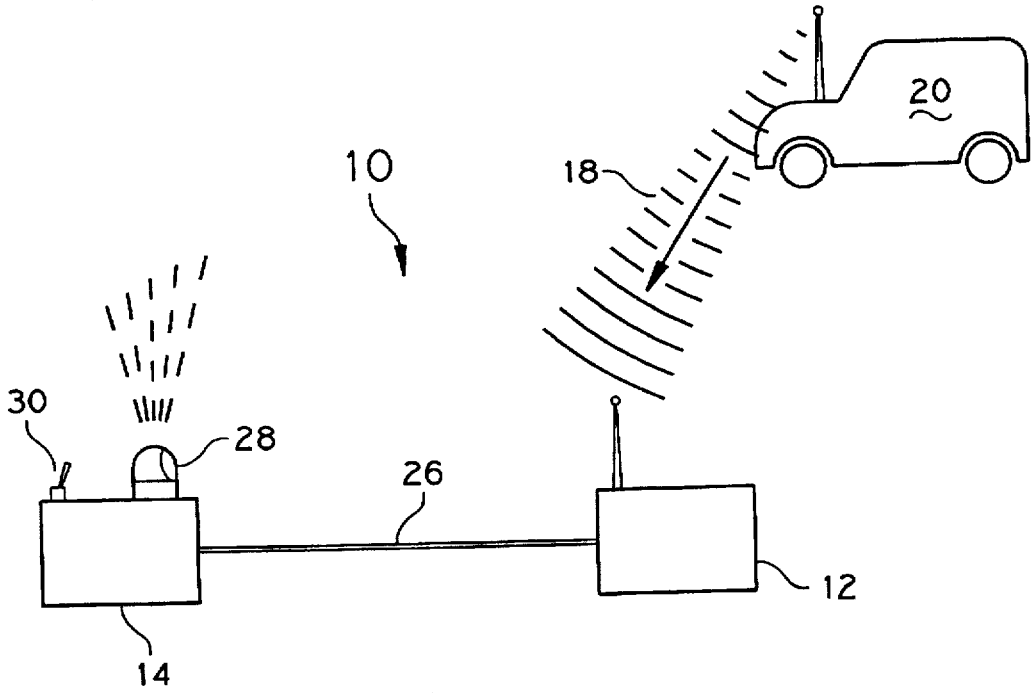
FIG. 2 is a schematic illustration of another embodiment of a system in accordance with the present invention.

Alternatively, and as illustrated in FIG. 2, an additional response member 28 may suitably be associated with control member 14 or otherwise positioned at the location of interest, and operatively connected or associated with receiving member 12 so as to be actuated upon approach of vehicle 20 as desired. In accordance with the invention, and advantageously, this configuration and the provision of additional response member 28 serves to notify persons at the desired location that the requested help or service or other expected vehicle is approaching. As set forth above, this serves to greatly reduce apprehension and stress of individuals at the particular location who may already be in need of medical attention.

Still referring to FIG. 2, it is contemplated that this embodiment could also be used in non-emergency settings. For example, receiver 12 could be adapted or configured to recognize signals 18 of the type issued by vehicles 20 such as school buses, while control member 14 and response member 28 are positioned within a particular residence. In accordance with the present invention, and advantageously, persons within a particular building or structure such as parents of a child returning from school will be notified of the approach of school bus 20 once receiver 12 receives signals 18 therefrom. In accordance with this embodiment, control member 14 and the other components of system 10 are preferably activated with a simple on/off switch 30 so as to be activated when desired.

As set forth above, traffic information warning systems in accordance with U.S. Pat. No. 5,497,148 involve the provision of various emergency and other vehicles with transmitters for transmitting various types of modulated and unmodulated signals of particular frequency. It is contemplated within the traffic information warning system of the of '148 patent that different types of vehicles will issue different types of signals. Furthermore, it is contemplated in accordance with the present invention that such vehicles could be adapted so as to send a different signal upon arriving at a particular location. This could be accomplished, for example, by associating the signaling hardware with the transmission controls for particular vehicles so as to detectably change the signal being sent when the vehicle is placed in "park".

In accordance with the present invention, the various signals to be generated by different types of vehicles may be used to advantage so as to identify the type of vehicle which is approaching. In this regard, receiver 12 and control member 14 are preferably adapted and programmed so as to receive and identify at least two and preferably a wide selection of different signals to be issued from different types of vehicles.

Figure 3:
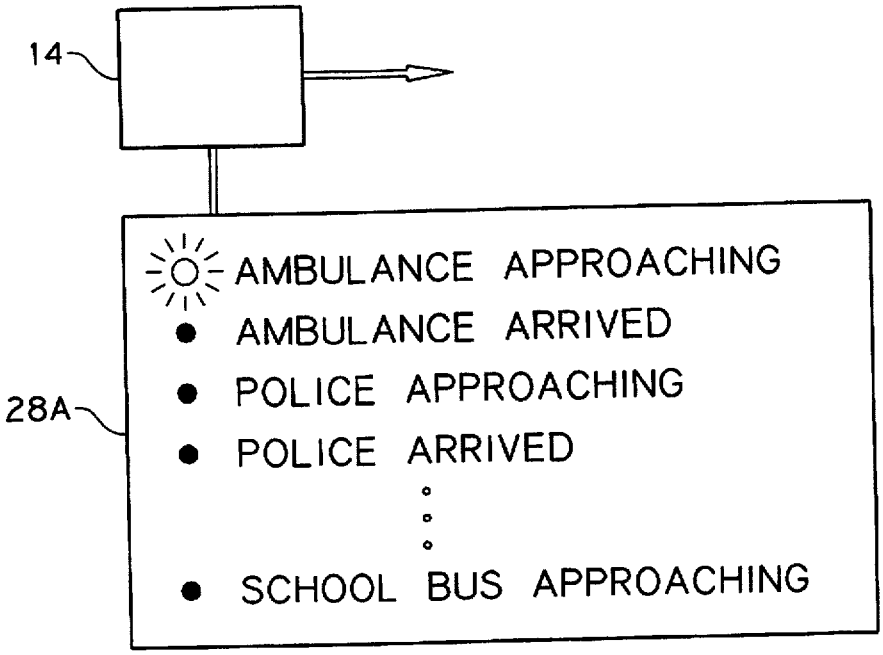
FIG. 3 illustrates an embodiment of a response indicator in accordance with the invention.

FIG. 3 illustrates an alternative embodiment of response member **28*a* which may be provided so as to issue a number of different responses depending upon the signal received by receiver 12. In FIG. 3, response member 28*a* may include responses to be generated for signals indicating any one or more of the following: ambulance approaching: ambulance arrived; police car approaching; police car arrived; school bus approaching; and numerous others. Control member 14 in accordance with this embodiment could be configured so as to activate a light corresponding to a particular listing on response member 28*a*, thereby advantageously advising and alerting occupants at the location of control member 14 of system 10** that a particular type of vehicle is approaching. In connection with emergency response type vehicles, and as set forth above, this advantageously serves to reduce the stressful waiting situations which may be experienced by already ill and/or injured persons waiting for help. Also as mentioned above, in non-emergency situations, this feature of the present invention advantageously serves to advise occupants of a building or home of the approach of a school bus carrying their children.

The embodiment of FIG. 3 schematically shows responses as visually generated on a board. It is to be appreciated that the response signal could be comprised of audio, visual or other indications, and combinations thereof, all within the scope of the present invention. Numerous other applications of a fixed installation such as that described in FIGS. 1–3 are also contemplated and will be further discussed below.

Figure 4:
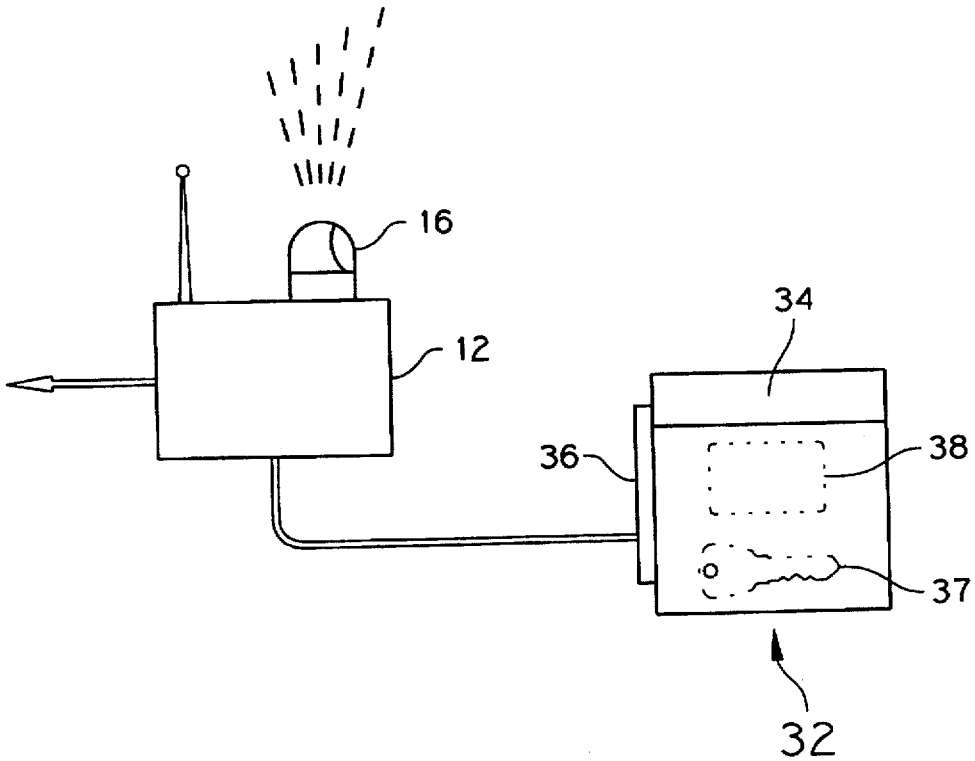
FIG. 4 schematically illustrates an access system for use in accordance with the present invention.

Referring now to FIG. 4, an additional embodiment of the present invention will be described. In accordance with this embodiment, response member 16 may suitably further include an access providing structure 32 operatively associated with receiver 12 and/or with control member 14. Control member 14 and/or receiver 12 are preferably configured so as to operate access providing structure 32 upon receiving a particular signal, so as to provide persons in an approaching vehicle 20, especially an approaching emergency vehicle, with means for entering a particular building, structure or the like. As shown in FIG. 4, access providing structure 32 may suitably be a lockable or secure container 34 having a locking structure or member illustrated schematically at 36, which is triggered by commands from control member 14 and/or receiver 12. The triggering of lock 36 serves to unlock container 34 and allow emergency personnel and the like access to the contents of container 34, which may be a key 37 for unlocking the entry to a particular structure, an identification or "swipe" card 38 for entering secured areas, or any other useful access materials or information such as medical information with respect to the occupant of a particular building and the like. In accordance with this embodiment of the invention, receiver 12 and control member 14 are most preferably configured so as to activate response member 16 upon the approach of a particular vehicle 20, and upon the receipt by receiver 12 of a signal indicating that vehicle 20 has shifted to a "park" position, thereby ensuring that container 34 remains locked until emergency personnel have actually arrived.

Figure 5:
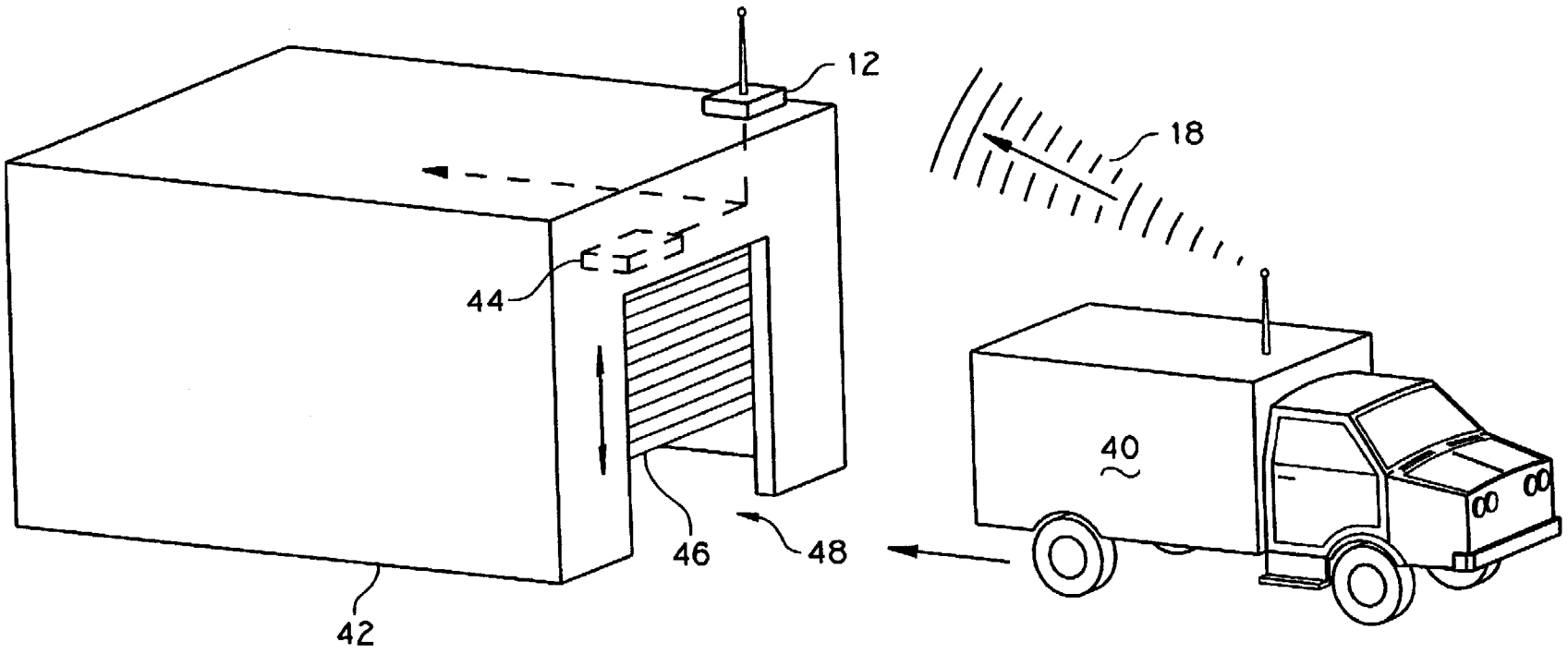
FIG. 5 illustrates the vehicle responsive alert system of the present invention in a particular environment of use.

Referring now to FIG. 5, it is further contemplated that the structural vehicle responsive alert system of the present invention could suitably be employed at business locations or buildings 42 where particular functions are desired upon the approach of a designated vehicle such as, for example, a delivery truck 40. In accordance with this preferred embodiment, receiver 12 may suitably be positioned so as to receive signals from approaching truck 40. Upon receiving and identifying a desired signal, receiver 12 and associated control member 14 (not shown in this drawing) are preferably configured so as to actuate a desired function at the business location 42. In the embodiment shown in FIG. 5, receiver 12 is shown operatively associated with an automatic door opening machine or structure 44 for opening a door 46 to an entrance bay 48 at business location 42.

System 10 according to this embodiment of the invention may also trigger the function of an auto-logging system at a business or other location so as to audit the progress of individual vehicles and the like, or to perform any of numerous other functions which may be desired.

In accordance with this embodiment of the invention, and advantageously, door 46 may be opened automatically upon the approach of truck 40 rather than personnel being required to watch for the approach thereof and then open door 46 at that time. Furthermore, most preferably, the desired function such as opening of door 46 may be triggered by certain signals from a vehicle such as a signal 18 issued by truck 40 when truck 40 is shifted into "reverse". In this manner, the automatic opening of door 46 can be limited to just before the time that truck 40 begins a backward approach to door 46. This advantageously serves to limit the exposure of the interior area of business location 42 which would result from opening door 46 before vehicle or truck 40 has actually reached the scene. Setting receiver 12 and control member 14 in this manner is particularly desirable in hot or cold environments, and especially where persons are working inside in the vicinity of door 46.

It should be appreciated that a large number of other business related functions or operations could be triggered by system 10 to begin or to stop upon the approach of vehicle 40 issuing the appropriate signal 18. For example, conveyor type machinery may be activated so as to carry cargo to be unloaded from truck 40 and transported to a destination by the conveyor. Additionally, lights could be switched on or off, personnel could be notified of their need to report to a particular vicinity within business location 42, and the like. Of course, the foregoing are examples only and are not to be considered to be limiting.

Figure 6:
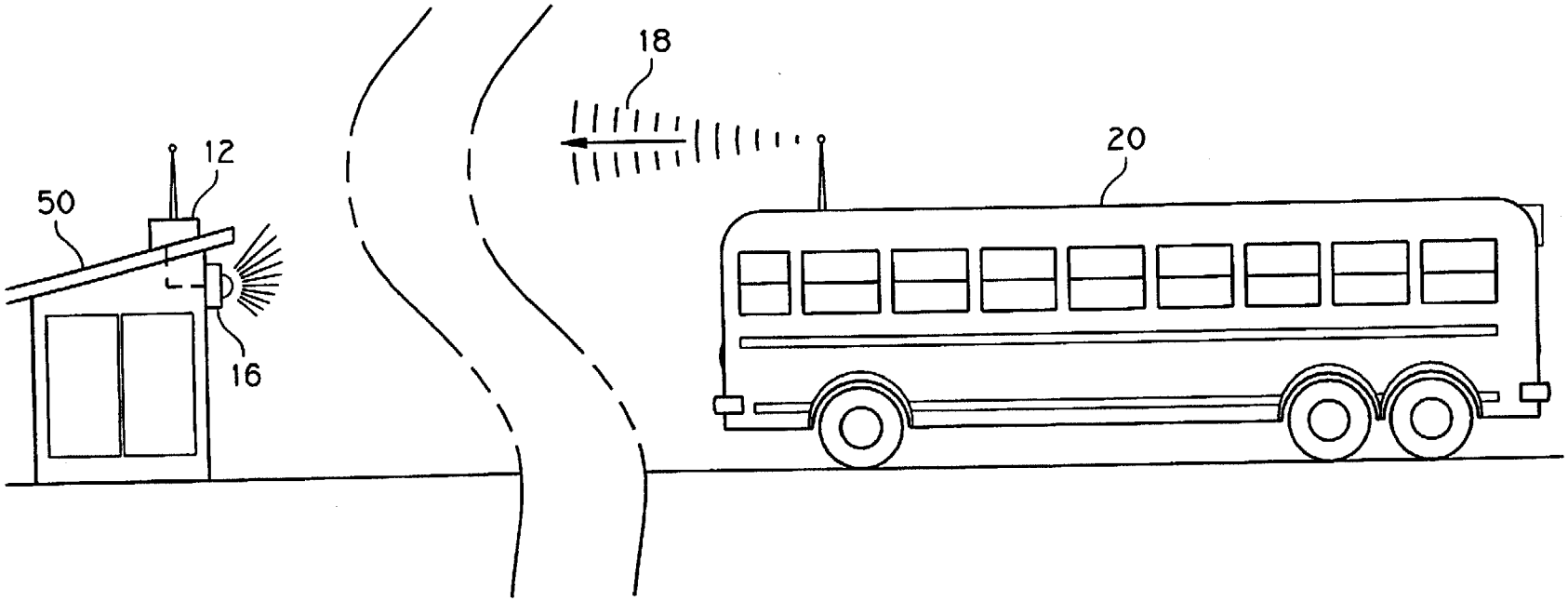
FIG. 6 illustrates an embodiment of the system of the present invention in another environment of use.

Referring now to FIG. 6, an additional alternative embodiment of the vehicle responsive alert system of the present invention will be described. According to this embodiment, system 10 could be installed at a bus stop 50 or at any other location where the approach of a municipal or other transportation vehicle is of interest. System 10, in accordance with this embodiment is preferably arranged with receiver 12 positioned to receive signals 18 from an approaching vehicle 20 such as a public bus, and response member 16 may suitably be a light or other indicator visible to or detectable by persons waiting at bus stop 50 which is activated when receiver 12 receives signal 18 from vehicle 20 in accordance with the invention. Other examples of fixed locations where system 10 according to the invention could be usefully employed include train stations, ferry crossings, docks, toll booths and numerous other fixed locations, and public safety equipment as set forth above.

It should be noted that system 10 according to the invention may be configured so as to receive and identify signals from a wide variety of vehicles equipped with transmitters in accordance with the teachings of the aforementioned '148 patent. Such vehicles include but are not limited to emergency vehicles such as police, fire, ambulance, paramedics and others, school buses, public transportation, delivery vehicles, repair vehicles, service vehicles, commercial transportation, trains and the like.

Figure 7:
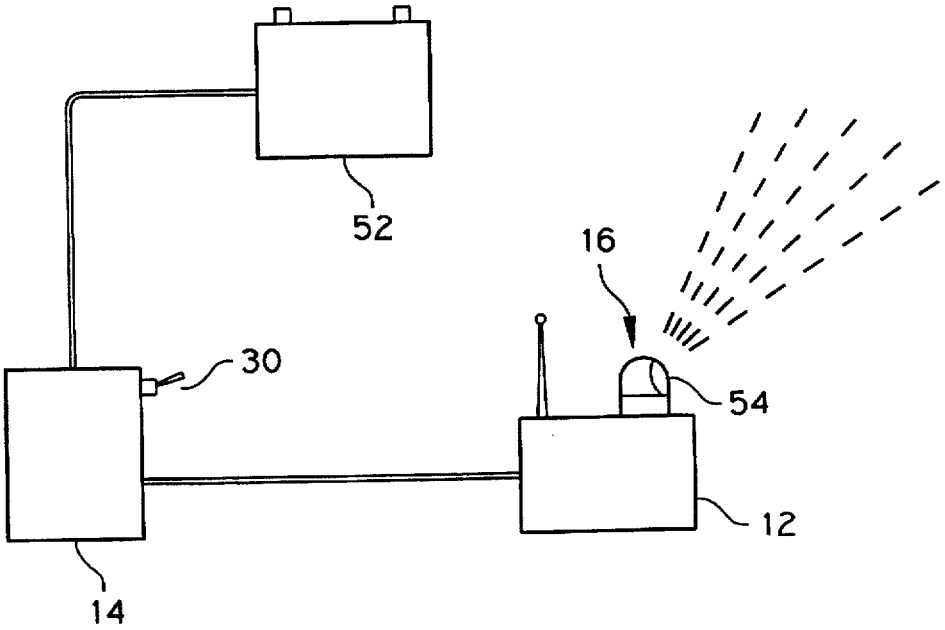
FIG. 7 schematically illustrates an embodiment of the invention for use in a vehicular environment.

According to another preferred embodiment of the invention, system 10 may be provided as factory installed or after-market safety equipment on a desired vehicle such as a personal automobile. FIG. 7 schematically illustrates elements of system 10 in such a configuration. System 10 is preferably interposed between a power source such as battery 52 of the vehicle and existing hazard lights or some other signal emitting member such as a strobe light 54 or other visual indicator which is intended to be used to attract the attention of responding emergency and/or service vehicles. System 10 according to this embodiment is manually activated using switch 30 or the like so as to activate receiver 12 for receiving signals 18 sent from responding emergency or other vehicles, and to activate response member 16 such as strobe light 54 as shown in FIG. 7 when receiver 12 receives the desired signal. When using system 10 according to the invention, a disabled vehicle need not drain limited power sources such as battery power by running hazard lights constantly to alert officials or responding vehicles. Such vehicles may unfortunately take extended periods of time to arrive at the scene of the disabled vehicle. Using system 10 according to the invention, power is conserved by limiting the operation of hazard lights and the like until such time as receiver 12 receives a signal from an approaching emergency or other vehicle 20, at which time hazard lights of the vehicle or other response-generating structure can be activated when needed so as to conserve the limited power resources of the disabled vehicle, and nevertheless issue a signal to alert an approaching service or emergency vehicle at the appropriate time.

Figure 8:
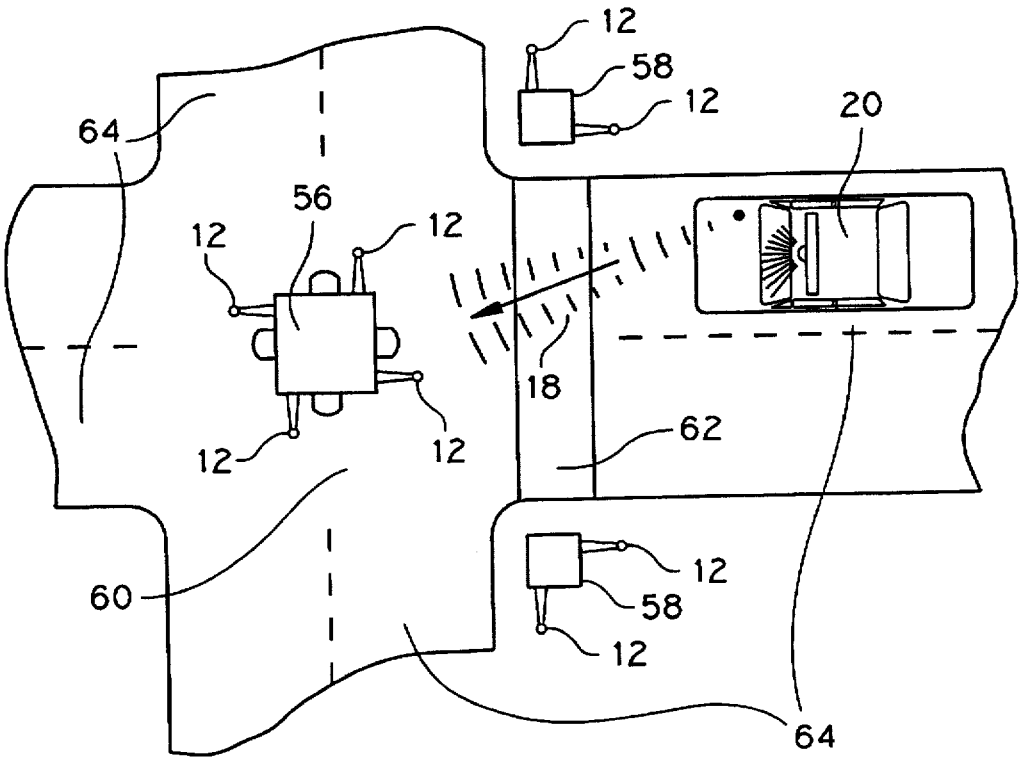
FIG. 8 illustrates an embodiment of the invention in connection with traffic control signals.

Referring now to FIG. 8, a further embodiment of the invention is illustrated. In this embodiment, system 10 may be associated with a traffic control member such as a vehicle signal light 56 or crosswalk crossing light 58 so as to cause the traffic control member to issue appropriate signals upon the approach of an emergency or other vehicle and thereby help to ensure the right of way for the vehicle. FIG. 8 shows an intersection 60 at which light 56 is positioned, and a crosswalk 62 having crossing lights 58. Either or both of lights 56, 58 may be provided with one or more receivers 12 according to the invention, and response members 16 operatively associated with lights 56, 58 for causing lights 56, 58 to issue a desired signal. For example, lights 56, 58 may be directed by response member 16 or control member 14 to issue "red " signals prohibiting vehicular and pedestrian traffic from entering intersection 60 and thereby help to ensure a clear intersection for emergency vehicle 20.

Further, system 10 may advantageously be adapted, for example at busy intersections having numerous approaches 64 thereto, to determine the direction of approach of an emergency or other vehicle and to issue independent signals responsive to same, one in the direction of approach of the vehicle and the other(s) in other directions of approach to intersection 60. In this regard, control member 14 may suitably be configured to determine the signal strength of the signal received by each of a plurality of directional and oriented receivers 12, and to thereby determine the strongest signal and the approach from which the strongest signal was received, which corresponds to the approach used by vehicle 20. Control member 14 in accordance with this embodiment may advantageously be configured so as to direct lights 56, 58 to issue different or at least independent signals in the directions of each approach 64 to intersection 60, and system 10 may advantageously be adapted to provide a "green" light facing the approach 64 of vehicle 20, and a "red" light in all other directions so as to help clear a busy or congested intersection.

It should be appreciated that there has been provided in accordance with the invention, a vehicle responsive alert system which advantageously employs vehicle signaling technology to provide enhanced ability to emergency personnel in rapidly arriving at emergency locations, and to provide additional peace of mind to persons waiting for such help, or for other expected vehicles.

It is also to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A vehicle responsive alert system comprising:

means at a location for receiving a recognizable signal from a preselected vehicle said means for receiving having a disabled state, an enabled state wherein said means for receiving is enabled to receive said signal, and a signal received state wherein said means for receiving has received said signal;

control means, positioned at said location and operatively associated with said means for receiving, for operating said means for receiving in said enabled state upon the indication of a preselected event; and response means operatively associated with said means for receiving for issuing a response when said means for receiving receives said signal, said response means having an inactive mode wherein no response is issued and an active mode wherein said response is issued, and wherein said response means is operated in said active mode when said means for receiving is in said signal received state, whereby said means for receiving is enabled upon the indication of said event and activates said response means upon receiving said signal.

2. A system according to claim 1, wherein said location is a vehicle, and said response means issues an exterior visible response when said receiving means receives said signal, whereby said response means issues said response when said preselected vehicle approaches said vehicle.

3. A system according to claim 2, wherein said vehicle has a power source and said response means is powered by said power source.

4. A system according to claim 3, wherein said response means further comprises means for unlocking at least one door to said vehicle when said means for receiving receives said signal.

5. A system according to claim 4, wherein said means for unlocking comprises a lockable container holding a key to said vehicle, said lockable container being operatively associated with at least one of said control means and said response means and wherein said at least one of said control means and said response means comprises means for unlocking said lockable container when said receiving means receives said signal.

6. A system according to claim 2, wherein said preselected event is disabling of said vehicle.

7. A system according to claim 2, wherein said preselected event is a call for assistance from said vehicle.

8. A system according to claim 1, wherein said location is a traffic control signal member, and wherein at least one of said control means and said response means is operatively associated with said traffic control signal member so as to cause said traffic control signal member to issue an appropriate traffic control signal when said means for receiving receives said signal.

9. A system according to claim 8, wherein said traffic control signal member is located at an intersection and includes means for providing an independent traffic control signal to different approaches to said intersection, and wherein said means for receiving includes means for identifying an approach of said preselected vehicle to said traffic control signal member, whereby an independent traffic control signal can be issued to said approach than to other approaches to said intersection.

10. A system according to claim 9, wherein said means for receiving comprises a plurality of means for receiving oriented at said intersection to face each approach to said intersection, and wherein said means for identifying said approach of said vehicle comprises means for determining a strength of said signal received at each of said means for receiving.

11. A system according to claim 8, wherein said traffic control signal member is selected from the group consisting of vehicular traffic signals, pedestrian signals, and combinations thereof.

12. A system according to claim 1, wherein said response means comprises signal means for issuing a signal detectable by said vehicle exterior of said location whereby said vehicle is guided to said location.

13. A system according to claim 12, wherein said response means further comprises signal means positioned at said location for alerting persons at said location to approach of said vehicle.

14. A system according to claim 1, wherein said means for receiving is adapted to receive and identify signals from at least two vehicles selected from the group consisting of emergency vehicles, school buses, public transportation, delivery vehicles, repair vehicles, service vehicles, commercial transportation and trains.

15. A system according to claim 14, wherein said response means is adapted to issue a different response for each signal of said at least two signals.

16. A system according to claim 1, wherein said response means further comprises means for providing access to said location upon receiving said signal.

17. A system according to claim 16, wherein said means for providing access comprises a lockable container holding access materials for said location, said lockable container being operatively associated with at least one of said control means and said response means and wherein said at least one of said control means and said response means comprises means for unlocking said lockable container when said receiving means receives said signal.

18. A system according to claim 1, further comprising a telephone system, and wherein said control means comprises a monitor for monitoring said telephone system and for enabling said receiving means when a preselected number is dialed on said telephone system.

19. A system according to claim 1, wherein said response means comprises signal means positioned at said location for alerting person at said location to approach of said vehicle.

20. A system according to claim 1, wherein said control means is positioned at said location and said means for receiving is positioned exterior of said location.

21. A system according to claim 1, wherein said means for receiving is adapted to receive and identify signals from vehicles selected from the group consisting of emergency vehicles, school buses, public transportation, delivery vehicles, repair vehicles, service vehicles, commercial transportation and trains.

22. A system according to claim 1, wherein said preselected vehicle issues a first recognizable signal while approaching said location and a second recognizable signal different from said first signal when said preselected vehicle has arrived at said location, and wherein said response means issues a first response when said receiving means receives said first signal and wherein said response means issues a second response when said receiving means said second signal.

23. A system according to claim 1, wherein said vehicle is a school bus and issues an identifiable signal, whereby persons at said location are alerted to approach of said school bus.

24. A system according to claim 1, wherein said location is a business and said vehicle is a business-related vehicle, and wherein said response means is operatively associated with a business related function whereby said function is initiated when said vehicle approaches said location.

25. A system according to claim 1, wherein said location is bus stop and said vehicle is a transportation vehicle assigned to said bus stop.

26. A vehicle responsive alert system according to claim 1, wherein said response means comprises means for issuing a response selected from the group consisting of a light, an audible alert, a wireless signal and combinations thereof.

27. A vehicle responsive alert system according to claim 1, wherein said control means has a passive state wherein said preselected event has not occurred, and a triggered state wherein said preselected event has occurred, and wherein said control means in said passive state operates said means for receiving in said disabled state and said response means in said inactive mode, and wherein said control means in said triggered state operates said means for receiving in said enabled state and said response means in said inactive mode, and operates said response means in said active mode when said means for receiving operates in said signal received state.

28. A vehicle responsive alert system comprising:

signal means associated with a vehicle for sending a recognizable signal from said vehicle, said means for receiving having a disabled state, an enabled state wherein said means for receiving is enabled to receive said signal, and a signal received state wherein said means for receiving has received said signal;

means at a location for receiving said signal from said vehicle;

control means, positioned at said location and operatively associated with said means for receiving, for operating said means for receiving in said enabled state upon the indication of a preselected event; and response means at said location and operatively associated with said means for receiving for issuing a response when said means for receiving receives said signal, said response means having an inactive mode wherein no response is issued and an active mode wherein said response is issued, and wherein said response means is operated in said active mode when said means for receiving is in said signal received state, whereby said means for receiving is enabled upon the indication of said event and activates said response means upon receiving said signal.

* * * * *